US007025529B2

(12) United States Patent
Boudreau

(10) Patent No.: US 7,025,529 B2
(45) Date of Patent: Apr. 11, 2006

(54) SELF-LEVELING SYSTEM

(75) Inventor: Guy Boudreau, Quebec (CA)

(73) Assignee: Zirga Inc., Gatineau (CA)

( * ) Notice: Subject to any disclaimer, the term of this patent is extended or adjusted under 35 U.S.C. 154(b) by 0 days.

(21) Appl. No.: 10/636,057

(22) Filed: Aug. 7, 2003

(65) Prior Publication Data

US 2004/0028470 A1 Feb. 12, 2004

(30) Foreign Application Priority Data

Aug. 7, 2002 (CA) ..... 2394898
Apr. 7, 2003 (CA) ..... 2425459

(51) Int. Cl.
*E02D 29/14* (2006.01)

(52) U.S. Cl. ..... 404/26; 404/25; 52/20; 52/19

(58) Field of Classification Search ..... 404/25, 404/26; 52/19, 20, 21
See application file for complete search history.

(56) References Cited

U.S. PATENT DOCUMENTS

| | | | | |
|---|---|---|---|---|
| 81,266 | A * | 8/1868 | Finnegan | 285/61 |
| 599,441 | A * | 2/1898 | Dorr | 404/26 |
| 1,033,448 | A * | 7/1912 | Finnegan | 210/163 |
| 1,254,641 | A * | 1/1918 | Adam | 220/3.7 |
| 2,254,668 | A * | 9/1941 | Tomek | 404/26 |
| 2,791,792 | A * | 5/1957 | Shearer, Sr. | 15/310 |
| 3,858,998 | A | 1/1975 | Larsson | |
| 4,255,909 | A * | 3/1981 | Soderstrom | 52/20 |
| 4,350,177 | A * | 9/1982 | Firchau et al. | 137/370 |
| 4,906,128 | A | 3/1990 | Trudel | |
| 5,117,877 | A * | 6/1992 | Sharp | 141/86 |
| 5,360,284 | A * | 11/1994 | Allard | 404/2 |
| 5,451,081 | A | 9/1995 | Kaucnik | |
| 5,470,172 | A | 11/1995 | Wiedrich | |
| 5,525,006 | A * | 6/1996 | Kilman et al. | 404/25 |
| 5,769,565 | A * | 6/1998 | Martin et al. | 404/25 |
| 6,109,824 | A | 8/2000 | Annès | |
| 6,402,423 | B1 * | 6/2002 | Stellmach | 404/26 |
| 6,524,026 | B1 * | 2/2003 | Sondrup | 404/26 |

FOREIGN PATENT DOCUMENTS

| | | |
|---|---|---|
| CA | 1172050 | 8/1984 |
| CA | 1270138 | 6/1990 |
| CA | 1287247 | 8/1991 |
| CA | 2151069 | 1/1997 |
| CA | 2222954 | 2/1999 |
| CA | 2212401 | 10/2000 |

OTHER PUBLICATIONS

Mueller Canada, Saint-Jerome, Quebec, Product Literature AJ-0497M, "Adjustable Inclinable Silencieux et Antivibrations", pp. 1 & 4.

(Continued)

*Primary Examiner*—Raymond W. Addie
(74) *Attorney, Agent, or Firm*—Conley Rose, P.C.

(57) ABSTRACT

Existing street sewers consist of an immobile concrete structure supporting a frame. The present invention, the self-leveling street sewer, comprises a frame that floats on the foundation of the street and a tubular section that is connected to the connecting conduit. Since the frame is supported only by the street foundation, the immobile concrete structure is no longer required.

3 Claims, 8 Drawing Sheets

OTHER PUBLICATIONS

La Fonderie Laperle, Saint-Ours, Quebec, Canada, Product Literature, "Cadres et Couvercles Auto Stable", p. 1 (front cover) & 2.

ROMOLD, Product Literature, "Losungen Fur Den Underground in PE/ PE Solutions For The Underground", pp. 24-25, online : <http://www.romold.de/files/kataloge/ROMOLD_Haupkat_MainCat_02.pdf> (date accessed: May 6, 2003).

ADS, Web Page, "Nyoplast Engineered Drainage Structures", online: <http://www.ads-pipe.com/us/en/products/basindrain.shtml> (date accessed: Sep. 10, 2003).

ADS, Product Literature, "Nyoplast", online: <http://www.ads-pipe.com/us/en/Product_Info/Online_Technical_Info/ADS_Product_Literature/nyloplast.pdf> at pp. 14-15 (date accessed: Sep. 10, 2003).

ADS, Product Literature, "Nyloplast 2'×3' Family", (Jun. 21, 2001), online: <http://www.ads-pipe.com/us/en/Product_Info/Online_Technical_Info/Nyloplast/7002-110-008.pdf> (date accessed: Sep. 10, 2003).

ADS, Product Literature, "Nyloplast New Style 18' & 24' Frame & Grate Example", (Dec. 10, 1999), online: <http://www.ads-pipe.com/us/en/Product_Info/Online_Technical_Info/Nyloplast/7001-110-005.pdf> (date accessed Sep. 10, 2003).

Groupe Norinco, Meru Cedex, France, Product Literature, "Gamme Selflevel", (Mar. 2001), p. 3.

PUISTAR, Saint-Nicolas, Quebec, Canada, Product Literature, "Puistar Une Solution Attendue Depuis Longtemps!", (May 2000), p. 3.

* cited by examiner

SELF-LEVELING SYSTEM

BACKGROUND OF THE INVENTION

The present invention relates to a self-leveling street sewer which, while serving both to collect surface water and to channel such water via a connecting conduit to the main storm sewer, supports a grating over which vehicular traffic can travel. In contrast both to the conventional street sewer and to the various concepts that have already formed the subject matter of previous inventions, the proposed self-leveling sewer does not require the installation of an immobile concrete structure since the frame is supported by the street foundation itself, while the tubular section is coupled to the connecting conduit.

A conventional sewer comprises a concrete structure that consists of a base upon which are seated a plurality of elevating rings up to a predetermined height. The base, which is situated below the frost line, sits upon a cushion of granular material that has been tightly packed in order to prevent the base from shifting over the years and moving the structure away from its predetermined height level. A connecting conduit connects the base to the main storm sewer. A frame, of circular or rectangular shape, as well as a grating of cast iron, are installed upon the upper portion of the immobile concrete structure. This type of installation permanently fixes the level at which the frame sits. The street foundation, which comprises granular material, and layers of paving material, are compacted all about the frame. This rather conventional method of installation, however, is attended by a number of disadvantages. With respect to the pavement, two problems ensue. Firstly, over the years, the foundation of the street settles considerably, a phenomenon that causes the level of the roadway to drop. Since the concrete structure is fixed in place, the frame is incapable of following the downward movement of the roadway surface and accordingly remains at a higher level. Secondly, the freezing that takes place every winter expands the foundation of the street and thereby raises the road surface. Since the depth at which the immobile concrete structure sits renders it insusceptible to such frost action, the frame always remains at its original level and therefore ends up sitting below the roadway surface. Such annual up-and-down movement of the earth (frost in the wintertime and thawing in the spring) gives rise to considerable deterioration in the immediate area of the conventional street sewer.

The underlying immobile supporting concrete structure is also a source of problems for the surrounding street foundation due to the presence of elevating rings that are raised up when the ground freezes. Such elevation of the rings creates a space in which small rocks, which come from the surrounding earth, can become lodged and so act to prevent the elevating rings from returning to their initial position during times of thaw. This opening in the underlying concrete structure permits infiltration of sand and gravel which results in the formation of a cavity in the street foundation and a weakening of the road surface in the immediate vicinity of the street sewer in question. Under loading, such small rocks act like punches to crack the elevating rings and so accelerate the deterioration of the underlying immobile concrete structure. In addition, municipal snow removal equipment may incur damage (when snow plows and graders strike the exposed frames), travellers in vehicles may experience discomfort and private motor vehicles may sustain damage. Frames sitting lower than the roadway surface can, particularly when traveled over by heavy vehicles such as buses, also give rise to vibrations that disturb the quiet in adjacent residential areas.

A number of prior art patents have proposed a variety of concepts in response to the foregoing problems. Canadian patents No. 2, 151, 069 (U.S. Pat. No. 5,470,172) and No.1,287,247 (U.S. Pat. No. 4,906,128) as well as U.S. Pat. No. 3,858,998 feature frames that always sit upon an underlying fixed load-absorbing concrete structure. Furthermore, the frame used in these systems must be adjusted manually.

Canadian patents No.1,270,138 and No.1,172,050 feature a peripheral strip supported upon a base that itself sits directly upon an underlying immobile concrete structure. The frame lifts up during the cold season when the ground expands and returns to its initial level during thaw. In this case as well, the prior art system uses both an underlying immobile load-absorbing concrete structure and a frame that will sit higher than the roadway surface when the street foundation settles some years later.

Canadian patents No. 2,222,954 and No. 2,212,401 (U.S. Pat. No. 6,109,824) feature a frame that is embedded in the street foundation and a section or head that allows the frame to move both vertically and angularly. These parts are designed to adapt to an underlying immobile concrete structure. However, in many cases, such parts cannot always be used to replace conventional street sewers that have already been in use for many years. The aforementioned problems are the most clearly evident in these systems, since it has been noted with respect to many such sewers that the height available between the top of the base and the road surface is not sufficient either to accommodate both parts and frame or to afford enough space to permit their effective operation. This situation has also been noted with respect to a great many conventional street sewers in more recent housing projects where the minimal depth has permitted the use of fewer elevating rings. It is absolutely essential to the proper functioning of the aforementioned inventions that the frame never touch the section or the head, lest it lose its ability to descend again. In addition, the available height must not be too restrictive, since the frame will end up being supported only on top of the ground above the base instead of on top of the street foundation. Since the magnitude of the expansion of the earth through freezing depends on thickness, the earth situated between the top of the base and the frame will add a vertical differential less than the relatively greater thickness of the street foundation that is situated beneath the pavement. In order to increase the space available between the base and the surface of the roadway, it is necessary to lower the base, which greatly increases installation costs. In addition, the presence of rock must be taken into consideration. Furthermore, adequate slope must be maintained for the connecting conduit, which translates into added excavation, and therefore extra costs.

It has been noted with respect to U.S. Pat. No. 2,212,401 (U.S. Pat. No. 6,109,824), that there is a problem of access to the bell that is situated in the base 6 of nearly all street sewers and whose function is to prevent floating debris from entering the main storm sewer and being carried into waterways. In essence, the positioning of the drainage conduit 9 permits maintenance crews to have direct access to said bell, but the notable feature of this invention, which is the eccentric position of the opening in head 5, does not in any way address the issue of access but rather only facilitates the positioning of frame 3 relative to the sidewalk or the curb line. This invention is also attended by problems arising from the lack of similarity between walls 37 and 38, a consequence of which being that both sides of frame 3 cannot sit equally upon the underlying ground, a situation that will likely cause frame 3 to rock back and forth.

In accordance with the novel concept proposed in the present invention, the frame comprises a horizontal or sloping external wall that permits loads to be transmitted directly to the underlying ground. This having been done, the frame compacts the surrounding underlying earth, thus providing for its own support, whereby the frame "floats", similarly to the pavement, on top of the street foundation. The frame will then perforce, simply, automatically and naturally, and without human intervention, follow, in the manner of the pavement, the up-and-down movements of the street foundation. The simultaneous movements of both frame and pavement will obviate any deterioration of the pavement surrounding the novel structure.

In all prior patents, the immobile underlying concrete structure is needed to support a number of elements that are germane and essential to the invention. Since the novel concept presently proposed does not contemplate any parts requiring support, the underlying fixed concrete structure is not needed. The concrete structure is replaced by a tubular section that is freely connected to the frame at its upper extremity and is coupled to the connecting conduit at its other extremity or, if a tank is present, at a certain distance along the wall thereof. The flexibility of the tubular section permits angular displacements of the frame. A tubular section of greater rigidity is permitted to displace angularly owing to the inclination of the lower wall of the frame. Insertion of a rubber collar between the upper extremity of the tubular section and the lower portion of the frame prevents infiltrations. The frame is free to displace along the tubular section.

This arrangement saves on labour and costs and reduces project complexity. There is no longer any heavy concrete structure to be manipulated, the cost of the tubular section is less than that of the immobile concrete structure and, since there is no frame to damage the compacting equipment and the diameter of the tubular section is smaller, the work of compacting about the tubular section is both facilitated and rendered more effective. Since the available height between the roadway and the connecting conduit may be severely limited, this novel concept can be used for old sewer installations where the connecting conduit is not situated at any great depth. In such cases, it is only a matter of adjusting the tubular section. Where older street sewers are to be renovated, and everything depends on dimensions and depth, the old base can be left in place and the tank of the tubular section slid toward it, or the extremity of the tubular section not having a tank can be connected to the existing connecting conduit, thus further facilitating installation and reducing costs. The space remaining in the base can then be filled in with granular material, which is then compacted.

BRIEF SUMMARY OF THE INVENTION

In one aspect of the invention, there is provided a self-leveling system that serves to prevent damage to the surrounding roadway and both a gully-hole and a street sewer. The system has both a frame comprising an upper portion and a lower portion, the frame being free to displace vertically and angularly, and a tubular section. The upper portion comprises a horizontal wall supported on the ground serving as the foundation thereof and transmitting the forces applied to the frame, and this in such a manner that the frame is supported by the ground. The upper portion has a downwardly-inclined internal wall serving to direct runoff water toward the tubular section. The upper extremity of the tubular section is engaged inside the lower portion. The frame is capable of sliding the length of the external wall of the tubular section so as to be able to displace vertically as a consequence of the expansion of the ground or of the settling of the ground. The frame is capable of positioning itself at an angle relative to the axis of the tubular section as a consequence of ground movement or so as to accommodate the slope of the ground.

In another aspect of the invention there is provided a self-leveling system designed to prevent damage to the roadway surrounding a gully-hole and a street sewer. The system comprises both a frame comprising both an upper portion and a lower portion, the frame being free to displace vertically and angularly and a tubular section. The upper portion comprises a support surface that is supported upon the ground which serves as the foundation thereof for the purpose of transmitting the forces applied to the frame in such a way that the frame is supported by the ground. The upper extremity of the tubular section is engaged inside the lower portion. The lower portion is preferably conical. The frame is capable of sliding along the external wall of the tubular section so as to allow the frame to displace in the vertical direction as a result of the expansion of the ground that is occasioned by the frost or as a result of the settling of the ground. The frame is capable of positioning itself at an angle relative to the axis of the tubular section as a result of ground movement or so as to follow the slope of the ground.

BRIEF DESCRIPTION OF THE SEVERAL VIEWS OF THE DRAWINGS

With regard to the illustrations and drawings that illustrate the concept proposed herein.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE INVENTION

Figure 1:
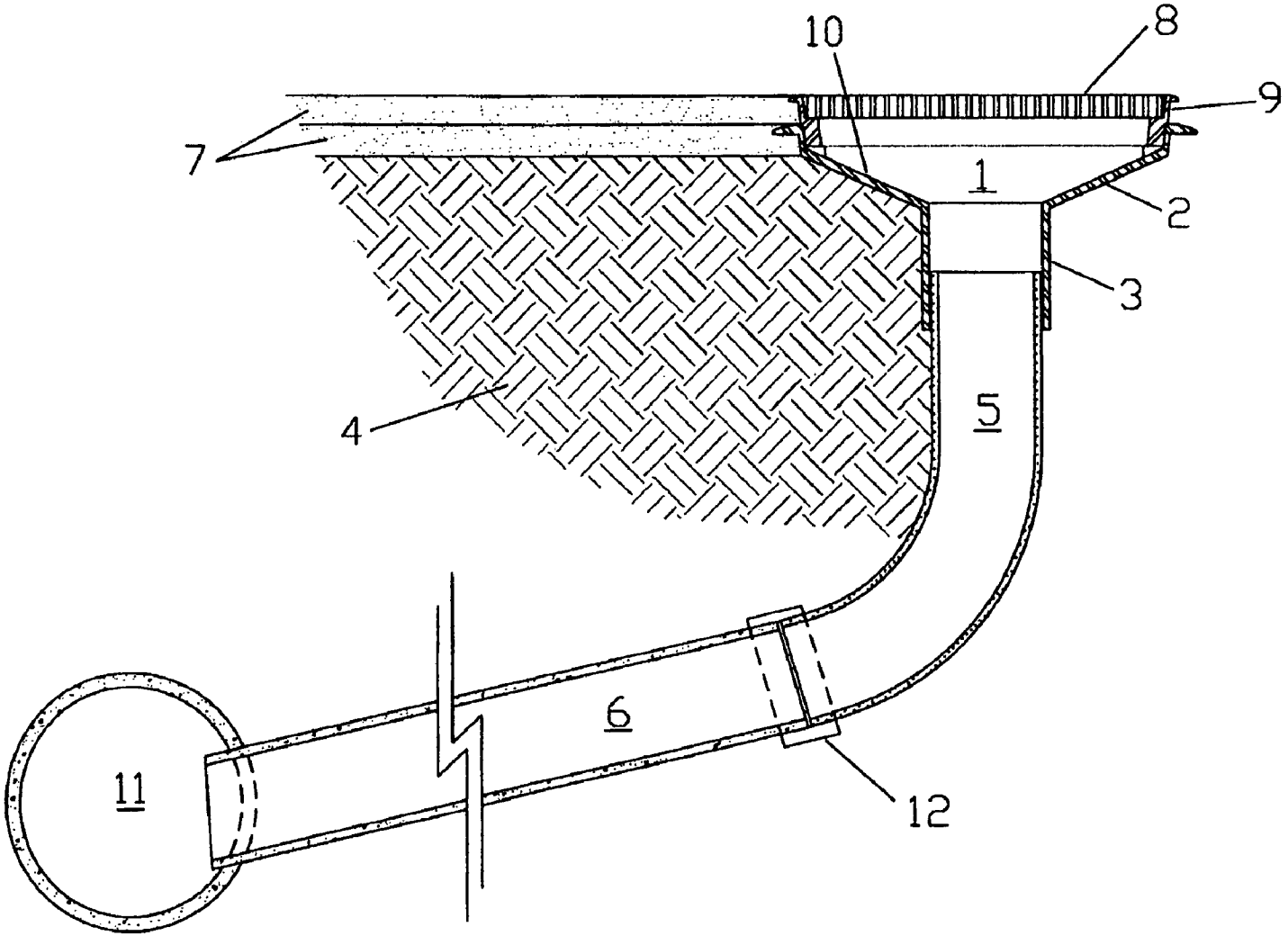
FIG. 1 shows the installation of a self-leveling street sewer together with a frame having an inclined external wall.

For installation in a new street of a self-leveling street sewer similar to that shown in FIG. 1, tubular section 5 is installed at the same time as both the main storm sewer 11 and the connecting conduit 6. Tubular section 5 is coupled to one extremity of connecting conduit 6 by means of a coupling element 12. The foundation 4 of the street is then constructed by compacting the granular material layer by layer, while each of the layers surrounding tubular section 5 is carefully and tightly compacted. Both the small diameter of tubular section 5 and the absence at this stage of frame 1, facilitates compacting all around said section. At this stage, the upper extremity of tubular section 5 extends above the final level of street foundation 4 in order both that the frame 1 can be properly positioned and that no granular material will find its way into tubular section 5. Once street foundation 4 has been well compacted, a small excavation in accordance with the dimensions of frame 1 and the slope of inclined external wall 2 is made manually around tubular section 5, so that frame 1 can be set into position. As frame 1 is being set into the aforedescribed small excavation up to the level of the first layer of pavement 7, the upper portion of tubular section 5 slides inside lower portion 3. Once frame 1 has been properly embedded with external inclined wall 2 resting upon street foundation 4, the upper extremity of tubular section 5 is cut below the lower limit of inclined internal wall 10, so as not to impede the flow of runoff water. The first layer of pavement 7 is laid down and then compacted. The equipment used to pack down the layer of pavement 7 also does a circuit around frame 1 and grating 8, so that everything will be uniformly compacted. Frame 1 is thus properly embedded in both street foundation 4 and pavement 7 and is free to displace along the upper extremity of tubular section 5 as it follows the movements of the underlying earth that supports it. When the second layer of pavement 7 is being laid down, an operation that can be accomplished immediately or afterwards, frame 1 remains in position and an elevating frame 9 is employed to lift grating 8 up to the same level as the second layer of pavement 7. The second layer of pavement 7 is laid down and compacted and the compacting equipment also circulates around the elevating frame 9 and grating 8 so that everything can be uniformly compacted. Thus, elevating frame 9 is directly supported upon frame 1 and is properly embedded in pavement 7. The movements of frame 1 are similar to those of pavement 7, both when this occurs during settling of street foundation 4 and during the up-and-down movements caused by alternating thawing and freezing. Frame 1, being free to displace along the upper extremity of tubular section 5, follows the movements of the underlying earth that supports it and thus, in the manner of pavement 7, "floats" on top of street foundation 4.

In order to replace a conventional street sewer with a self-leveling street sewer, the immobile concrete structure is removed. It is also possible to remove only the elevating rings and leave the base in the ground. Tubular section 5 is coupled to connecting conduit 6 by means of a coupling element 12 and the excavation (and the base, if necessary) is filled in with compacted granular material. The rest of the installation procedure with respect to this arrangement is similar to that for a new street.

Figure 2:
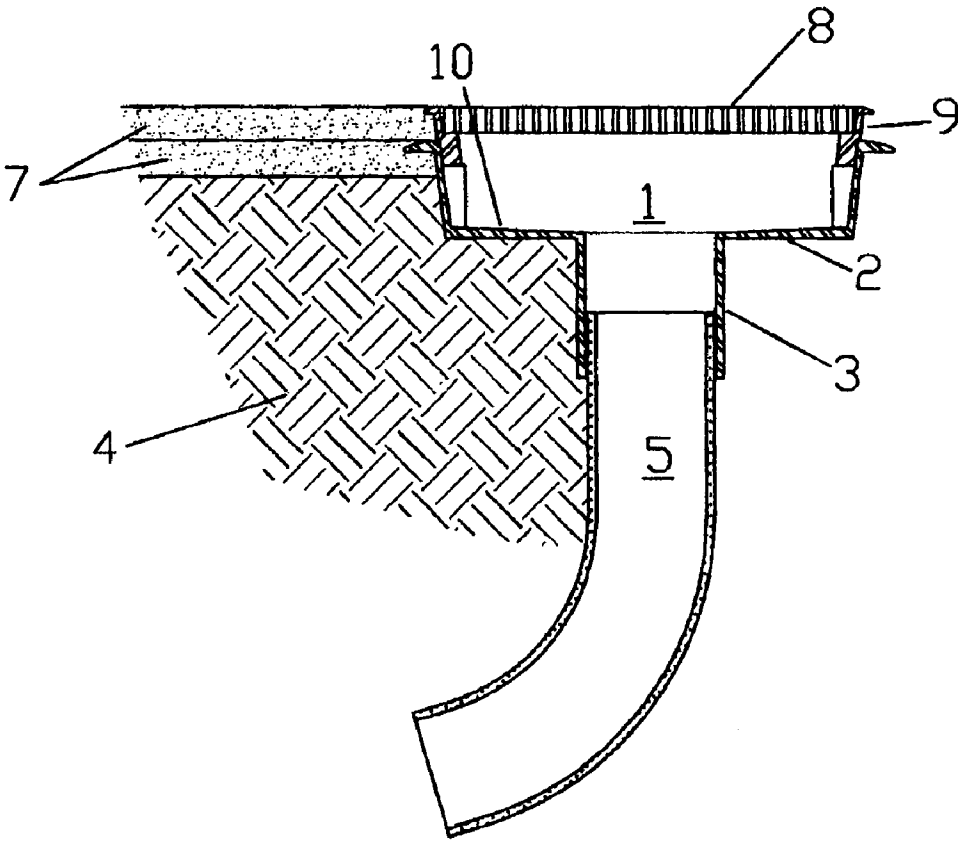
FIG. 2 shows a self-leveling street sewer together with a frame having a horizontal external wall.

FIG. 2 shows that the upper portion of frame 1 can possess a horizontal external wall 2, and, with respect to capacity to transmit loads directly to the surrounding underlying earth and permit frame 1 to be supported upon street foundation 4, confer the same advantages as external inclined wall 2. This equivalency derives from the fact that the load produced by horizontal external wall 2 is directed vertically and obliquely downward due to the absence of any underlying structure. Internal inclined wall 10 remains to direct surface water toward tubular section 5.

Figure 3:
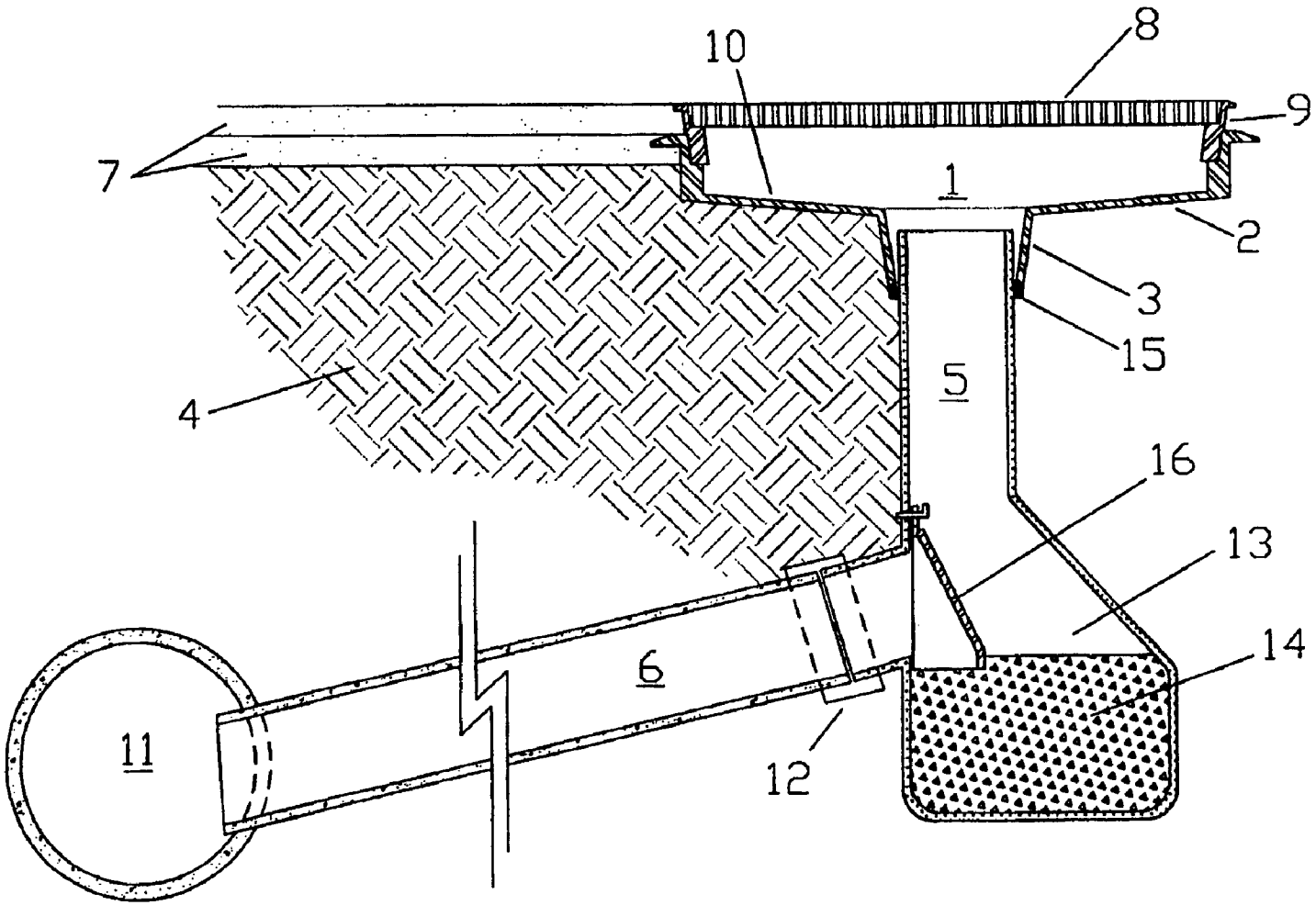
FIG. 3 shows the installation of a self-leveling street sewer together with a tubular section having a tank at its lower extremity.

FIG. 3 shows that tubular section 5 can possess an extremity embodied as a tank 13 for the purpose of holding floating debris 14 carried along with the surface water, and this in order to prevent such debris from entering the main storm sewer 11. Lower portion 3 possesses an inclined wall in order to permit the angular displacement of frame 1 given the slope of the roadway. A rubber collar 15 serves to prevent infiltrations. A bell 16 is so installed in relation to the lower opening of frame 1 as to be accessible from the outside while permitting floating debris 14 to remain in tank 13. Where a conventional street sewer is to be replaced by a self-leveling street sewer possessing a tubular section featuring a tank 13, the immobile concrete structure is removed. It is also possible to remove only the elevating rings and leave the base in the ground. Tank 13 is then slid into the base, tubular section 5 is coupled to connecting conduit 6 by means of coupling element 12 and the excavation is filled in with compacted granular material. The rest of the installation procedure is the same as that for a new street.

Figure 4:
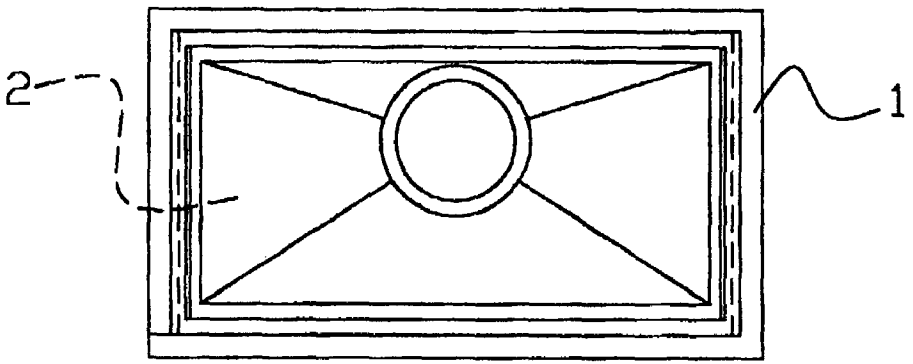
FIG. 4 is a plan view of the frame that shows the eccentricity between the upper opening and the lower opening of the frame.

FIG. 4 illustrates a plan view showing the eccentricity of the opening in the lower portion relative to the opening of the upper portion thereof. While the opening in the lower portion is situated toward the outer edge of the roadway, this eccentricity permits horizontal or inclined external wall 2 of frame 1 to present a larger support surface toward the inside of the roadway, i.e. the area where repetitive vehicular loading is more prevalent. Such increased support surface will prevent frame 1 from tilting towards the inside of the roadway.

Figure 5:
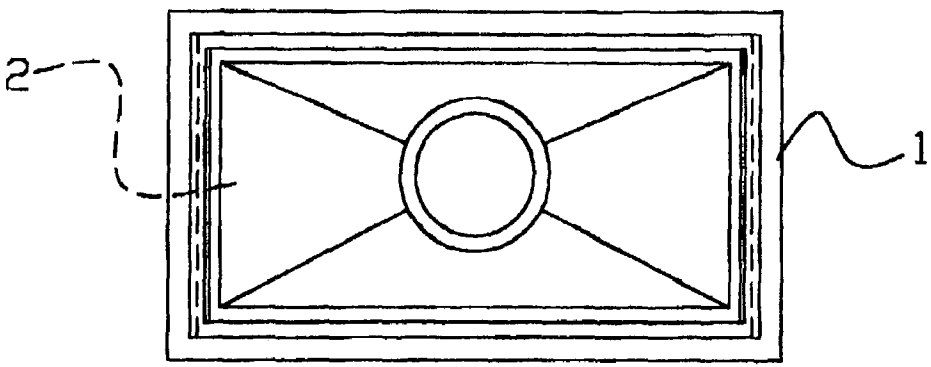
FIG. 5 is a plan view of the frame which shows the alignment of the upper opening with the lower opening of the frame.

In cases in which loads originate from all sides, such as, for example, in the middle of a parking lot, the two openings in frame 1 are aligned as shown in FIG. 5. Such centering of the lower opening permits horizontal or inclined external wall 2 to present a support surface of equal size on both opposing sides.

Figure 6:
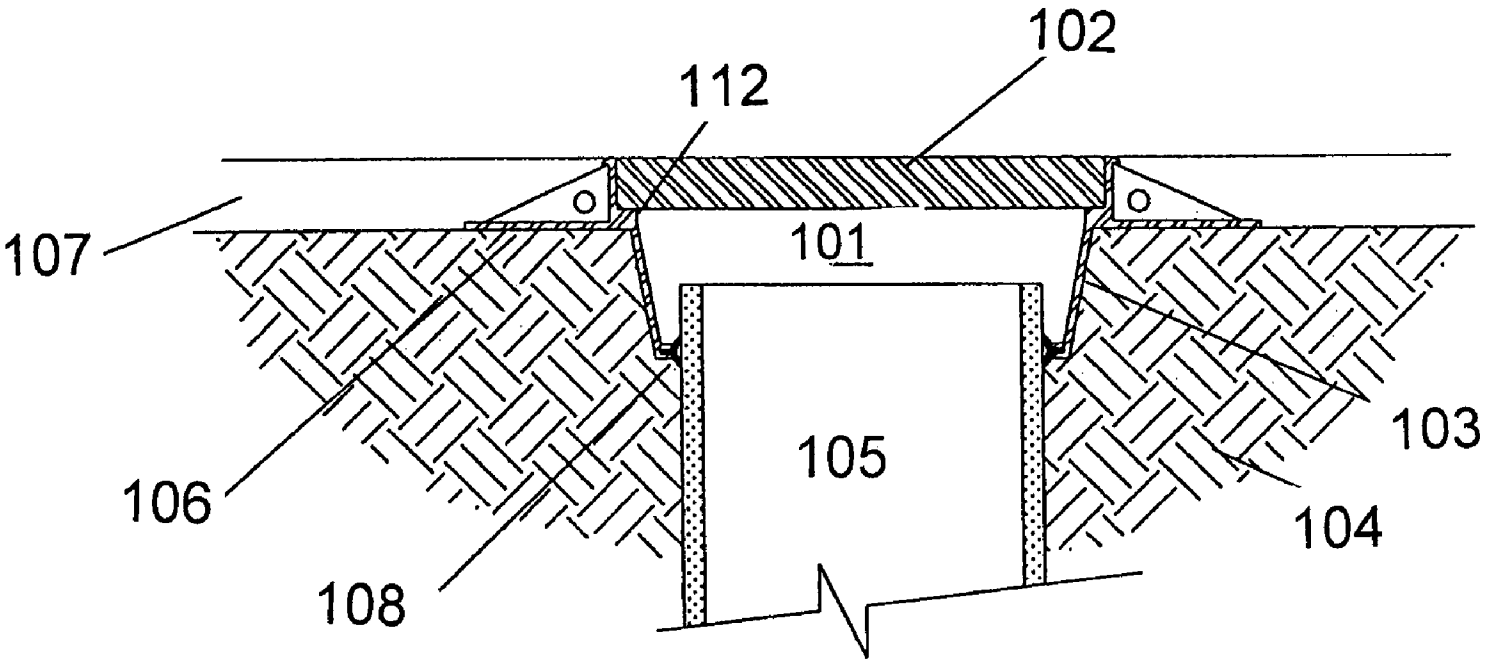
FIG. 6 shows a section through a gully-hole together with an embodiment of the self-leveling system in accordance with the present invention.
Figure 7:
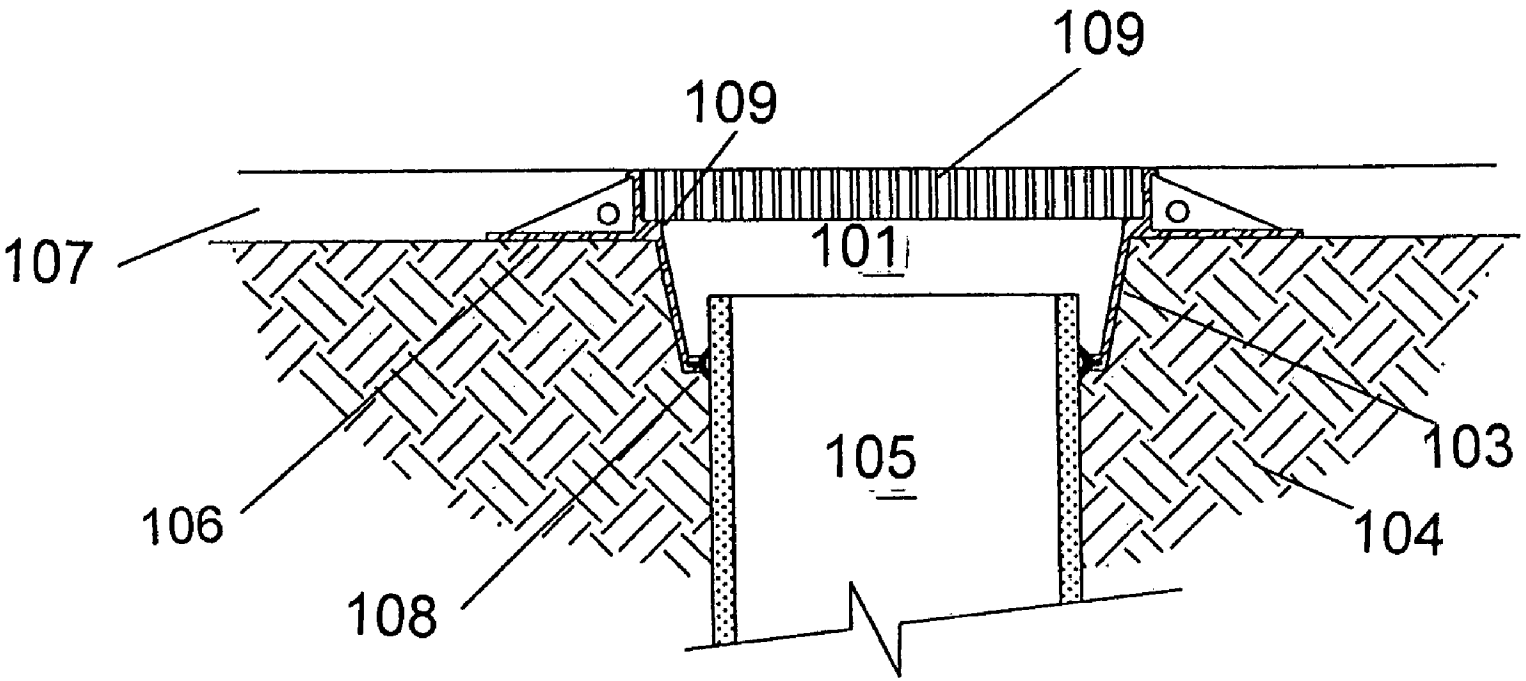
FIG. 7 shows a section through a street sewer together with an embodiment of the self-leveling system in accordance with the present invention.
Figure 8:
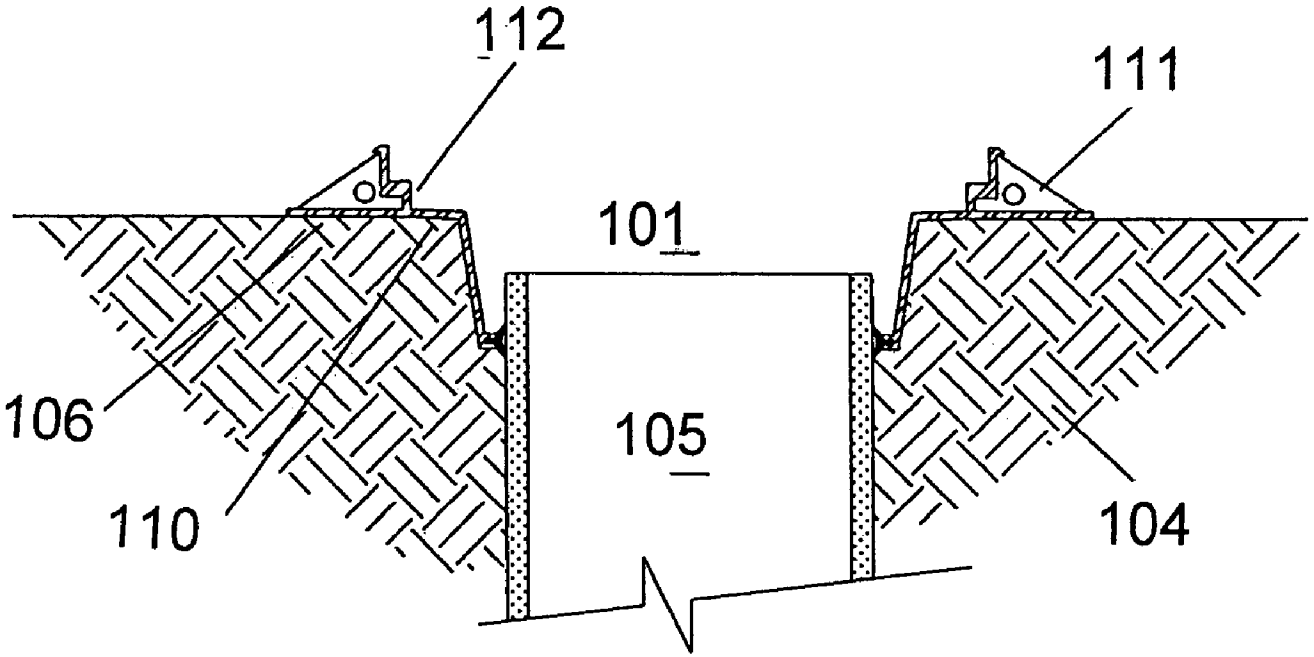
FIG. 8 shows a section through the frame of an embodiment of the self-leveling system.
Figure 9:
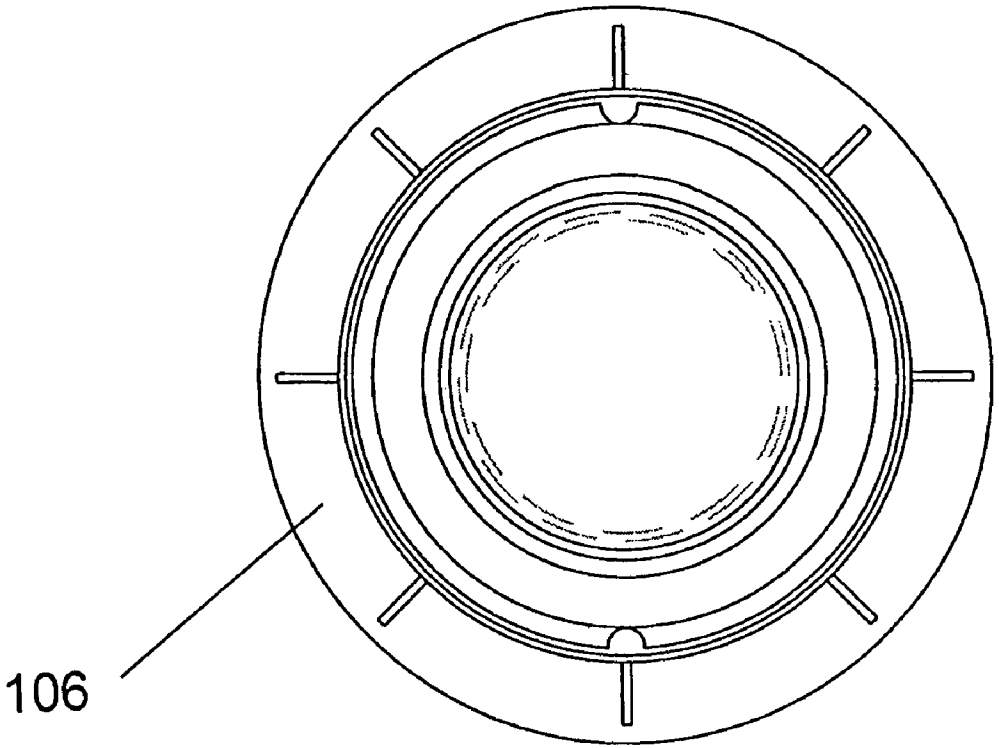
FIG. 9 shows a plan view of the frame of an embodiment of the self-leveling system.

For the installation of a street sewer or a gully-hole together with the embodiment of the self-leveling system as illustrated in FIG. 6, 7 or 8, tubular section 105 is installed in foundation 104. At this stage, the upper extremity of tubular section 105 extends beyond the final level of foundation 104 in order to prevent granular material from infiltrating tubular section 105. Once foundation 104 has been well compacted, a small excavation, in accordance with the shape and dimensions of the lower portion of frame 101, is made manually around tubular section 105 in order to allow placement of frame 101 in this location. Frame 101 is set in place by engaging the upper portion of tubular section 105 inside lower portion 103 until the surface of support 106 is properly seated upon foundation 104. As shown, lower portion 103 is preferably conical, angled inwardly towards tubular section 105. Collar 108 permits formation of a watertight seal between tubular section 105 and frame 101. Once frame 101 has been properly seated upon foundation 104, the upper extremity of tubular section 105 is cut in order to allow placement of cover 102 or grating 109. Next, the layers of pavement 107 are laid down and compacted.

FIG. 8 shows that, given the dimensions of the covers and the gratings, the shape of frame 101 can be varied depending on the diameter of tubular section 105. In some cases, upper portion 112 can feature an external wall 110 that is supported upon foundation 104. Such external wall 110 thus allows a certain degree of support upon foundation 104, but the limited surface of such external wall 110 is not sufficient to permit adequate load bearing. A support surface 106 must therefore be added. Support surface 106 also permits the addition of vanes 111 which serve to stabilize upper portion 112 of frame 101.

Thus, it is apparent that there has been provided in accordance with the invention a self-leveling system for sewers and gulley holes that fully satisfies the objects, aims and advantages set forth above. While the invention has been described in conjunction with illustrated embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What is claimed is:

1. A self-leveling system that serves to prevent damage to the roadway surrounding a gully-hole and a street sewer, the system comprising:

a frame having an upper portion and a lower portion; and a tubular section;

wherein the upper portion of the frame has a horizontal wall which serves to transmit to the ground forces directly applied to the frame, such that the frame is supported by the ground, wherein an upper extremity of the tubular section is engaged inside the lower portion of the frame, such that the frame is free to move relative to the tubular section as a result of forces exerted upon the frame as a result of the expansion of the ground occasioned by the frost or as a result of settling of the surrounding ground, wherein the lower portion of the frame has an inclined wall which allows the frame to move angularly in any direction relative to the axis of the tubular section as a result of differential settling of the surrounding ground or as to follow the slope of the ground, and wherein the tubular section remains at its same position during vertical or angular movement of the frame.

2. The self-leveling system as defined in claim 1, wherein the upper portion of the frame has a downwardly inclined internal wall which serves to direct run-off water toward the tubular section.

3. The self-leveling system as defined in claim 1, wherein the upper and lower portions of the frame each has an aperture for receiving run-off water, the aperture of the upper portion being eccentric relative to the aperture of the lower portion.

* * * * *